United States Patent [19]

Inoue

[11] Patent Number: 4,813,623

[45] Date of Patent: Mar. 21, 1989

[54] DISPERSING AND GRINDING APPARATUS HAVING REMOVABLE MOUNTING STRUCTURE

[75] Inventor: Masakazu Inoue, Tokyo, Japan

[73] Assignee: Inoue Seisakusho (Mfg) Co., Ltd., Kanagawa, Japan

[21] Appl. No.: 148,546

[22] Filed: Jan. 26, 1988

[30] Foreign Application Priority Data

Jan. 26, 1987 [JP] Japan ..... 62-8639[U]

[51] Int. Cl.[4] ..... B02C 17/18

[52] U.S. Cl. ..... 241/171; 241/172; 241/285 R

[58] Field of Search ..... 241/171, 172, 285 R, 241/285 A; 209/233, 660

[56] References Cited

U.S. PATENT DOCUMENTS 4,273,295 6/1981 Pollmann ..... 241/172 X

*Primary Examiner*—Mark Rosenbaum

*Attorney, Agent, or Firm*—Bruce L. Adams; Van C. Wilks

[57] ABSTRACT

A dispersing and grinding apparatus has a vessel for receiving a material to be processed and a grinding medium. A rotationally driven rotary shaft extends into the vessel and carries an agitator for dispersing, grinding and agitating the material within the vessel by the cooperative actions of the rotating agitator and the grinding medium. A separator removably installed at the discharge end of the vessel separates the processed material from the grinding medium so that the processed material is discharged from the vessel while the grinding medium is retained in the vessel for re-use. A mounting structures removably attached to the apparatus rotatably supports the rotary shaft and the separator. The mounting structure includes a sleeve removably slidably inserted onto a portion of the rotary shaft which extends out of the vessel. The sleeve is rotatably mounted on the mounting structure and releasably connected to the rotary shaft to rotate therewith. By detaching the mounting structure from the apparatus and disconnecting the sleeve from the rotary shaft, the mounting structure together with the sleeve and separator can be removed as a unit from the apparatus for service and repair without extracting the rotary shaft and agitator from the vessel.

17 Claims, 2 Drawing Sheets

DISPERSING AND GRINDING APPARATUS HAVING REMOVABLE MOUNTING STRUCTURE

BACKGROUND OF THE INVENTION (1) Field of the Invention

The present invention relates generally to dispersing and grinding apparatus having a rotationally driven agitator for dispersing, grinding, and agitating a material by means of a grinding medium and more particularly, to a removable mounting structure for rotatably mounting the agitator and which can be removed from the apparatus without requiring removal of the agitator.

(2) Background Information

Dispersing and grinding apparatus are in widespread use for dispersing, grinding and agitating various types of materials. These apparatus are commonly known as dispersion agitators or grinding mills and employ a rotationally driven agitator in conjunction with a grinding medium, such as balls, beads or other particulates, to accomplish the grinding and comminuting action. After the material is suitably dispersed, ground and agitated, the processed material must be separated from the grinding medium. For this purpose, a separator is frequently installed at the discharge end of the apparatus for separating the processed material from the grinding medium such that the processed material is discharged from the apparatus whereas the grinding medium is retained in the apparatus for re-use.

One common type of separator is the so-called dynamic separator which comprises a stationary stator and a rotatable rotor. The stator and rotor are spaced apart a slight distance so that a small gap exists between the rim of the rotor and the stator to define a discharge passage for the processed material. The size of the gap is smaller than the size of the particulates which constitute the grinding medium thereby ensuring that the grinding medium cannot pass through the gap.

This type of dispersing and grinding apparatus typically employs a grinding vessel in which are charged the material to be processed and the grinding medium, and a rotary shaft extends into the vessel for rotationally driving the agitator. The rotary shaft is usually directly supported on the apparatus by rotary bearings, and sealing means, such as mechanical seals, packings and the like, are installed directly on the rotary shaft. Over prolonged periods of use, the bearings and seals become worn and require replacement. In the prior art constructions, the servicing and replacement of such parts are time-consuming and troublesome tasks because the bearings and seals act directly on the rotary shaft. As a consequence, it is necessary to extract the rotary shaft together with the agitator from the grinding vessel in order to service and replace the bearings and seals.

When the dispersing and grinding apparatus is equipped with a dynamic separator, the rotor, stator, and usually both, become quickly abraded by the abrading action of the grinding medium and, therefore, need frequent replacement. This is due to the fact that as the rotor rotates, the grinding medium tends to accumulate and concentrate at the rim area of the rotor. Consequently, the grinding medium is carried along with the rotating rotor and abrades and wears out the confronting surfaces of the stator and rotor. As the rotor is usually secured directly to the rotary shaft which rotationally drives the agitator, it is necessary to remove the rotary shaft from the apparatus in order to service or replace the worn rotor and stator. Moreover, in those constructions in which the agitator is secured directly to the rotary shaft, it is usually necessary to extract the agitator from the grinding vessel in order to remove the rotary shaft to enable servicing, repair or replacement of the worn parts of the separator. Such a procedure is time-consuming, troublesome and uneconomical.

SUMMARY OF THE INVENTION

One object of the present invention is to provide a dispersing and grinding apparatus which overcomes the aforementioned drawbacks and disadvantages.

Another object of the present invention is to provide a dispersing and grinding apparatus having an agitator which is rotationally driven by a rotary shaft to disperse, grind, and agitate a material by the cooperative actions of the rotating agitator and a grinding medium and in which a mounting structure for rotatably mounting the rotary shaft can be removed from the apparatus without the need of removing the rotary shaft or agitator.

A further object of the present invention is to provide a removable mounting structure for rotatably mounting a rotary shaft in a dispersing and grinding apparatus and which can be removed from the apparatus without requiring removable of the rotary shaft in order to permit servicing and replacement of the bearings and seals which rotatably support the rotary shaft.

A still further object of the present invention is to provice a dispersing and grinding apparatus having a separator for separating processed material from a grinding medium and in which the separator is removably attached to the apparatus to enable easy removal thereof to permit servicing and replacement of worn parts of the separator.

Yet another object of the present invention is to provide a dispersing and grinding apparatus for dispersing, grinding and agitating a material by the cooperative actions of a rotating agitator and a grinding medium and which is rugged and durable in a construction and which enables simplified replacement of worn parts and easy servicing.

These as well as other objects, features and advantages of the invention are carried out by a dispersing and grinding apparatus having a vessel for receiving a material to be processed and a grinding medium. A rotationally driven rotary shaft extends into the vessel and carries an agitator for dispersing, grinding and agitating the material within the vessel by the cooperative actions of the rotating agitator and the grinding medium. A separator is removably installed at the discharge end of the vessel for separating the processed material from the grinding medium such that the processed material is discharged from the vessel while the grinding medium is retained in the vessel for re-use. The separator comprises a stationary stator, and a rotatable rotor mounted so that the rim area of the rotor is spaced from and faces the stator to define therebetween a small gap which is large enough to permit the processed material to discharge therethrough though small enough to prevent the grinding medium from passing therethrough. A sleeve is removably slidably inserted onto a portion of the rotary shaft which extends out of the vessel, and the sleeve is releasably secured to the rotary shaft to undergo rotation therewith. The sleeve and the rotor of the separator are rotatably supported by a mounting structure which is detachably connected to the apparatus. By such a construction, the mounting structure together with the sleeve and separator can be removed as a unit from the apparatus for service and repair without extracting the rotary shaft and agitator from the vessel.

The aforementioned objects, features and advantages of the present invention, as well as others, will become more readily apparent to persons of ordinary skill in the art upon a reading of the following description of the invention when read in conjunction with the accompanying drawings.

DESCRIPTION OF THE PREFERRED EMBODIMENT

The present invention is applicable to both horizontal- or vertical-type dispersing and grinding apparatus. In the following description, reference will be made to a vertical-type apparatus, and it is understood that the principles of the invention can likewise be applied to a horizontal-type dispersing and grinding apparatus.

Figure 1:
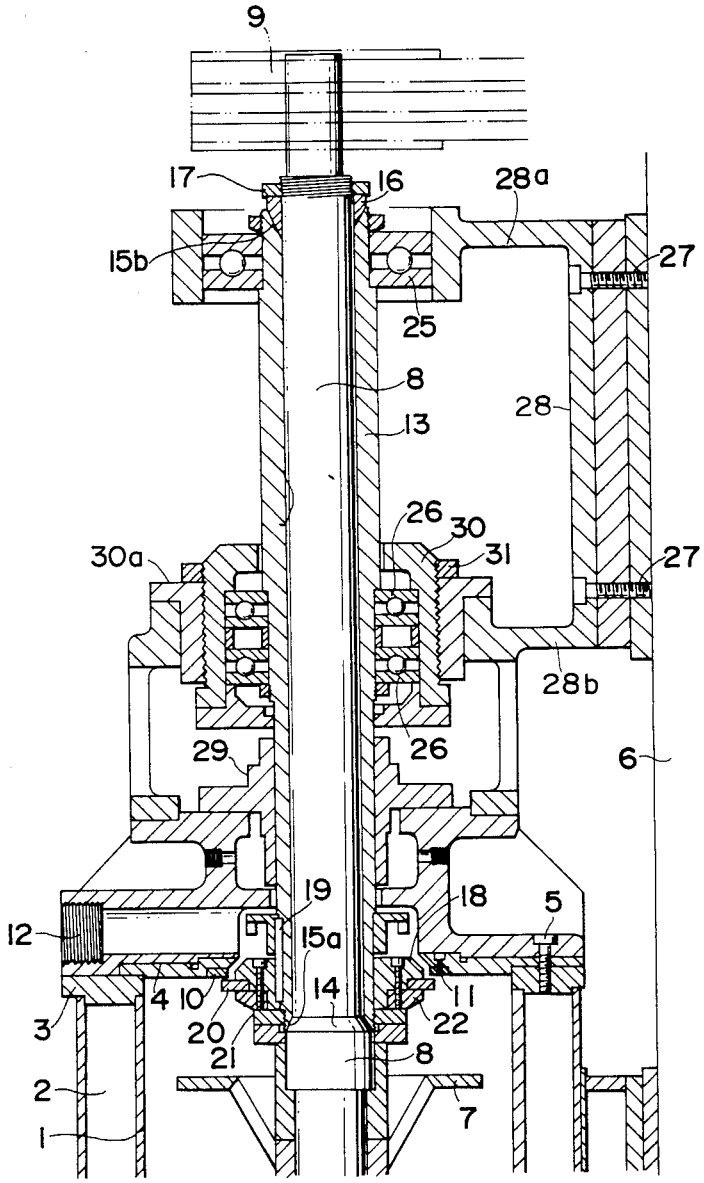
FIG. 1 is a longitudinal sectional view of part of a dispersing and grinding apparatus showing the removable mounting structure according to the principles of the present invention.

FIG. 1 shows one embodiment of a vertical-type dispersing and grinding apparatus. The apparatus has a vertically disposed grinding vessel 1 which contains means (not shown) for admitting a material to be processed. Also contained within the grinding vessel 1 is a grinding medium (not shown) which may comprise balls, beads, or other suitable particulates. The particular grinding medium does not constitute part of the present invention, and the choice of grinding medium will depend on the nature of the material being processed and the kind of processing to be done. The grinding vessel 1 is surrounded by an annular jacket 2 which may be used to circulate a cooling medium, heating medium, insulating medium or the like. The upper end of the jacket 2 is closed by a plate member 3, and the upper end of the vessel 1 is closed by a flange 4. A set of fastening bolts 5 removably secure the flange 4 to the plate member 3. The grinding vessel 1 and the jacket 2 are fixably secured to a main body 6 of the apparatus.

An agitator 7 is disposed within the vessel 1 and is secured to a rotary shaft 8 to undergo rotation therewith. The rotary shaft 8 extends into the grinding vessel 1 where it is secured to the agitator 7, and the upper end of the rotary shaft 8 extends upwardly out of the vessel 1. A set of pulleys 9 is removably secured to the upper end of the rotary shaft 8. A drive motor (not shown) acts through belts to rotationally drive the set of pulleys 9 to thereby rotate the rotary shaft 8 and the agitator 7. As the agitator 7 rotates, the material contained within the grinding vessel 1 is dispersed, ground and agitated by the cooperative actions of the rotating agitator and the grinding medium, and the processed material is progressively advanced upwardly toward the upper end of the grinding vessel 1 in a manner well known in the art.

Figure 2:
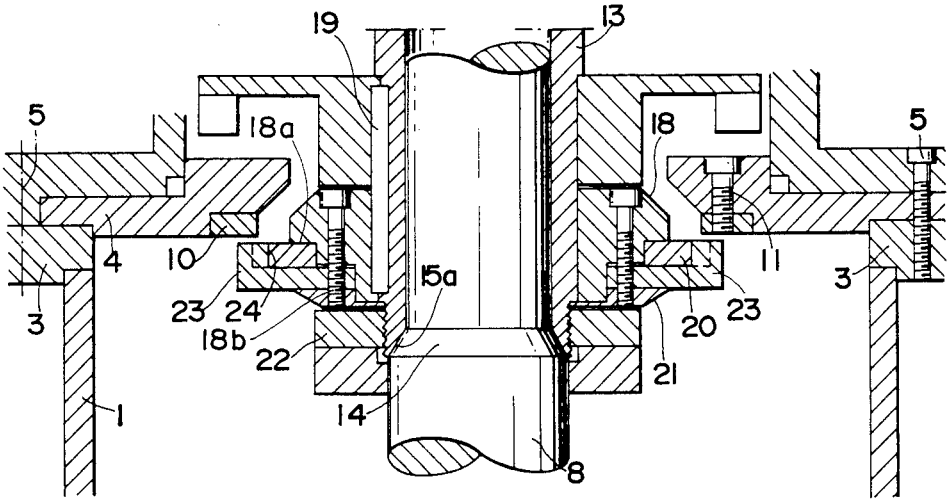
FIG. 2 is an enlarged longitudinal sectional view of the separator portion of the apparatus shown in FIG. 1.

A separator is installed at the upper portion of the grinding vessel 1 as shown in FIGS. 1 and 2. The separator comprises a stationary stator assembly and a rotatable rotor assembly. The stator assembly comprises the flange 4 which is provided with a central opening, and an annular, ring-shaped stator 10 removably secured to the underside of the flange 4 by fastening bolts 11.

The rotor assembly comprises a support member 18 which is removably secured to the rotary shaft 8 to undergo rotation therewith by means of a key-and-groove connection. The key-and-groove connection comprises a sleeve 13 releasably connected to the rotary shaft 8 to rotate therewith (as described hereinafter), and a key 19 inserted into a pair of opposed grooves formed in the sleeve 13 and the support member 18. In this manner, the rotation of the rotary shaft 8 is transmitted through the keyed connection to the support member 18. An annular recess **18*a* is formed around the periphery of the support member 18, and a disc-shaped rotor 20 of generally circular shape is mounted in the recess 18*a* and extends radially outwardly of the support member 18. A back plate 21 is provided on the underside of the support member 18 and engages with the underside of the rotor 20 to secure the rotor to the support member 18. A set of fastening bolts 18*b* are used to fasten together the support member 18, the rotor 20 and the back plate 21 to thereby define the rotor assembly. A threaded nut 22 is threaded onto the lower end of the sleeve 13 in order to maintain the axial position of the rotor assembly on the sleeve 13**.

Figure 3:
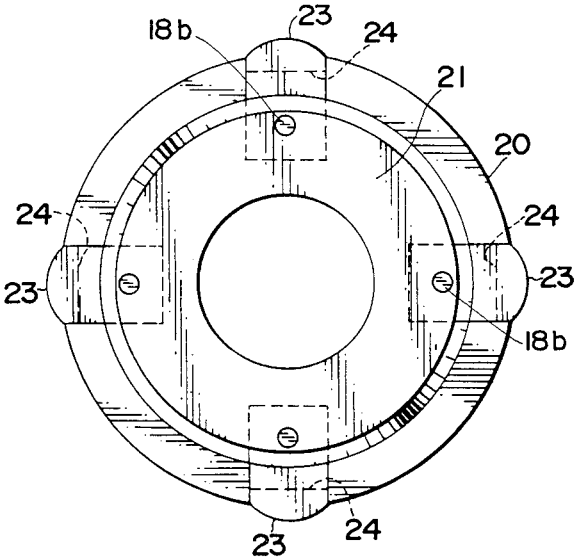
FIG. 3 is an enlarged bottom view of the rotor assembly of the separator shown in FIG. 2.

The rotor 20 is provided with a plurality of circumferentially spaced-apart protruding portions 23 which extend radially outwardly from the periphery of the rotor 20. In this embodiment, the protruding portions 23 comprise separate projecting members 23. Each projecting member 23 has a radially extending base portion which extends into an opening in the support member 18 between the rotor 20 and the back plate 21, and a tip portion connected to the outer end of the base portion and extending upwardly flush with the upper surface of the rotor 20. As shown in FIGS. 2 and 3, the rotor 20 has a plurality of peripheral grooves 24 into which extend the tip portions of the protruding members 23. The protruding members 23 are removably engaged in respective ones of the rotor grooves 24 and are removably fastened to the support member 18 by means of the bolts **18*b*. As shown in FIG. 3, which is a bottom plan view of the rotor assembly, the tip portions of the protruding members 23 extend radially outwardly from the periphery of the rotor 20, and the outermost ends of the protruding members have an arcuate shape. In this embodiment, the rotor 20 is provided with four protruding portions 23**; however, in accordance with the principles of the invention, the number of protruding portions may be more or less than four.

As shown in FIGS. 1 and 2, a peripheral surface portion of the rotor 20 is spaced from and faces a peripheral surface portion of the stator 10 to define a small gap between the the rotor 20 and the stator 10. The small gap is suitably dimensioned to permit the processed material to flow therethrough and be discharged from the grinding vessel 1 through an outlet 12 but is too small to permit the passage therethrough of the grinding medium. The gap spacing may be selectively varied, depending on the size of the particular grinding medium, by adjusting the axial position of the rotor assembly relative to the stator assembly in a manner to be described hereinafter. When the relative positions of the stator 10 and the rotor 20 are selected and set, the gap spacing will be too small to permit the grinding medium to fit therethrough so that only the processed material will exit through the gap and be discharged through the outlet 12. The protruding portions 23 are carried by the rotor 20 so that as the rotor rotates, the protruding portions 23 likewise rotate and centrifugally disperse the grinding medium away from the confronting peripheral surface portions of the stator 10 and the rotor 20. The protruding portions 23 exert a centrifugal force on the grinding medium located in the region of the rim area of the rotor, the centrifugal force being effective to disperse the grinding medium radially outwardly. By such a construction, the grinding medium is prevented from accumulating and concentrating at the rim area of the rotor thereby greatly diminishing the abrading of the rotor and stator surfaces and greatly prolonging the useful life of the separator.

According to the invention, a removable mounting structure is provided for rotatably mounting the rotary shaft 8 and for mounting the separator so that the mounting structure can be removed from the main body 6 of the apparatus without removing the rotary shaft 8 and the agitator 7 from the grinding vessel 1 of the apparatus. The removable mounting structure comprises the sleeve 13 which is removably slidably inserted onto the rotary shaft 8 as shown in FIG. 1. The sleeve 13 is releaseably connected to the rotary shaft 8 to undergo rotation therewith by a pair of connecting means disposed at opposite ends of the sleeve. At the lower end of the sleeve 13, the connecting means comprises complimentary tapered portions of the rotary shaft 8 and the sleeve 13. As best seen in FIG. 2, an intermediate portion of the rotary shaft 8 is provided with a tapered shaft portion 14 which tapers radially outwardly in the downward direction of the shaft 8, and the lower end of the sleeve 13 is provided with a tapered inner surface 15*a* which likewise tapers radially outward in the downward direction. The tapered shaft portion 14 of the rotary shaft 8 complements the tapered inner surface 15*a* of the sleeve 13 so that when the sleeve 13 is urged downwardly, the sleeve tapered inner surface 15*a* presses firmly against the tapered shaft portion 14 to thereby frictionally engage the sleeve 13 with the rotary shaft 8. The connecting means disposed at the upper end of the sleeve 13 is shown in FIG. 1 and comprises a tapered inner surface 15*b* of the sleeve 13 which tapers radially outwardly in the upward direction, and an annular wedge 16 removably slidably inserted onto the upper end of the rotary shaft 8 in wedging engagement with the sleeve tapered inner surface 15*b*. A threaded nut 17 is threaded onto the rotary shaft 8 for urging the wedge 16 downwardly into tight wedging engagement with the tapered inner surface 15*b* of the sleeve 13. By suitably tightening the nut 17, the outer tapered surface of the wedge 16 is urged into tight frictional engagement with the tapered inner surface 15*b* and the inner surface of the wedge 16 is urged into tight frictional engagement with the peripheral surface of the rotary shaft 8. At the same time, the sleeve 13 is urged downwardly so that the tapered inner surface 15*a* at the lower end of the sleeve 13 is urged into frictional engagement with the tapered shaft portion 14. In this manner, the sleeve 13 is releasably connected to the rotary shaft 8 so that the two rotate together as an integral structure.

In order to rotatably mount the sleeve 13, the removable mounting structure includes a frame member 28 detachably connected by bolts 27 to the main body 6 of the apparatus. The frame member 28 includes a pair of spaced-apart supporting arms 28*a* and 28*b*. The upper supporting arm 28*a* carries a rotary bearing 25 for rotatably mounting the upper end portion of the sleeve 13, and the lower supporting arm 28*b* carries a pair of rotary bearings 26, 26 for rotatably supporting the mid-portion of the sleeve 13. The rotary bearings 26, 26 are contained within a bearing box 30 which is threadedly connected to a collar 30*a* fixed to the lower supporting arm 28*b*. By virtue of a threaded connection between the bearing box 30 and the collar 30*a*, the axial position of the sleeve 13 can be adjustably set by simply threading in or backing out the threaded bearing box 30. Once the desired axial position is selected, the position is maintained by a lock nut 31 which is threaded onto the bearing box 30 into engagement with the collar 30*a*. Moreover, by adjusting the axial position of the sleeve 13, the gap spacing between the stator 10 and the rotor 20 is likewise adjusted since the rotor assembly is secured to the sleeve 13. A mechanical seal 29 is provided around the sleeve 13 in the vicinity of the discharge outlet 12 to prevent leakage of the processed material flowing through the discharge outlet. Other sealing means, such as packings and the like, could be used instead of the mechanical seal 29.

When it becomes necessary to service, repair or replace worn or damaged parts of either the separator or the structure which rotatably supports the rotary shaft 8, such can be easily accomplished without the need of extracting the rotary shaft 8 and the agitator 7 from the grinding vessel 1 or otherwise removing the shaft and agitator from the apparatus. For example, during use of the apparatus, the stator 10 and the rotor 20 eventually become worn thereby leading to failure of the mechanical seal 29. As another example, after prolonged use of the apparatus, the rotary bearings 25, 26 require replacement as do the various seals and packings which deteriorate through use and the passage of time and require replacement. These repairs and replacements as well as routine servicing and maintenance of the apparatus can be easily attended to. In order to remove the removable mounting structure, the set of pulleys 9 is removed from the upper end of the rotary shaft 8, and the threaded nut 17 is backed off of the threaded portion of the rotary shaft 8 and slid upwardly together with the wedge 16 and removed. Then, after removing the fastening bolts 5 and 27, the mounting structure comprised of the frame member 28 together with the parts connected thereto can be displaced upwardly to thereby remove the sleeve 13 from the rotary shaft 8. After the mounting structure is removed from the apparatus, the rotary bearings, seals, packings, and other parts are easily accessible for service and repair as are the stator 10, rotor 20 and other parts of the separator. After the desired service, repair and maintenace work is completed, the mounting structure is easily installed on the apparatus by simply reversing the steps used to remove the mounting structure. When installing the mounting structure onto the apparatus, before connecting the sleeve 13 to the rotary shaft 8, the axial position of the sleeve 13 is suitably adjusted by means of the threaded bearing box 30. After the desired axial position of the sleeve 13 is set, the lock nut 17 is installed and the nut 17 is tightened down to releaseably connect the sleeve 13 to the rotary shaft 8.

As described above, the dispersing and grinding apparatus of the present invention greatly simplifies the service, repair, replacement and adjustment of the various parts. The structure which rotatably supports the rotary shaft 8 can be easily removed from the apparatus without the need of extracting the rotary shaft 8 and the agitator 7 from the grinding vessel 1 thereby making the apparatus of the invention more economical to operate and more simple to maintain and service than comparable prior art apparatus.

What is claimed is:

1. In a dispersing and grinding apparatus having a vessel for receiving a material to be processed and a grinding medium: a rotationally driven rotary shaft extending into the vessel and having an end portion thereof extending out of the vessel; agitating means disposed within the vessel and connected to the rotary shaft to undergo rotation therewith for dispersing, grinding and agitating the material within the vessel by the cooperative actions of the rotating agitating means and the grinding medium; separating means for separating the processed material from the grinding medium and effecting discharge of the processed material from the vessel while retaining the grinding medium within the vessel; and mounting means for rotatably mounting the rotary shaft portion which extends out of the vessel, the mounting means having means removably connected to the rotary shaft portion to enable disconnection of the mounting means from the rotary shaft and removal of the mounting means from the apparatus without removing the rotary shaft and agitating means from the vessel.

2. A dispersing and grinding apparatus according to claim 1; including means connecting the separating means to the mounting means to enable removal of the mounting means and separating means together as a unit from the apparatus.

3. A dispersing and grinding apparatus according to claim 2; wherein the separating means comprises a stationary stator having a peripheral surface portion, a rotatable rotor having a peripheral surface portion, and means rotatably mounting the rotor to undergo rotation in response to rotation of the rotary shaft and positioning the rotor such that the rotor peripheral surface portion faces the stator peripheral surface portion to define a small gap therebetween for the discharge of processed material.

4. A dispersing and grinding apparatus according to claim 3; wherein the means rotatably mounting and positioning the rotor includes means for adjustably setting the position of the rotor relative to the stator to enable adjustment of the spacing of the gap between the rotor and stator.

5. A dispersing and grinding apparatus according to claim 3; wherein the separating means includes dispersing means carried by the rotor to undergo rotation therewith for centrifugally dispersing grinding medium which tends to accumulate at the rotor peripheral surface portion during use of the apparatus.

6. A dispersing and grinding apparatus according to claim 1; wherein the mounting means comprises a sleeve removably slidably inserted onto the rotary shaft portion, means for releasably connecting the sleeve to the rotary shaft portion to undergo rotation therewith, and means detachably connected to the apparatus for rotatably mounting the sleeve.

7. A dispersing and grinding apparatus according to claim 6; wherein the means for rotatably mounting the sleeve includes a pair of rotary bearings disposed in axially spaced relation on the sleeve.

8. A dispersing and grinding apparatus according to claim 6; wherein the means for rotatably mounting the sleeve includes a set of rotary bearings enclosed within and carried by a bearing box.

9. A dispersing and grinding apparatus according to claim 8; including means for effecting adjustment of the axial position of the sleeve relative to the vessel, the means for effecting adjustment comprising means mounting the bearing box for displacement in the axial direction of the sleeve, and means for releasably locking the bearing box in a preselected axial position.

10. A dispersing and grinding apparatus according to claim 6; including means for adjustably setting the axial position of the sleeve relative to the vessel.

11. A dispersing and grinding apparatus according to claim 10; wherein the separating means comprises a stationary stator having a peripheral surface portion, a rotatable rotor having a peripheral surface portion, and means connecting the rotor to the sleeve to undergo rotation therewith and positioning the rotor such that the rotor peripheral surface portion faces the stator peripheral surface portion to define a small gap therebetween for the discharge of processed material, the spacing of the gap being adjustably set by adjustably setting the axial position of the sleeve.

12. A dispersing and grinding apparatus according to claim 11; wherein the means for releasably connecting the sleeve to the rotary shaft portion comprises means disposed at opposite end portions of the sleeve coacting with complementary means on the rotary shaft portion.

13. A dispersing and grinding apparatus according to claim 12; wherein the means disposed at one end portion of the sleeve comprises a tapered inner surface of the sleeve which tapers radially outwardly in a direction towards the sleeve one end, and the complementary means on the rotary shaft portion comprises an annular wedge removably slidably inserted onto the rotary shaft portion in wedging engagement with the tapered inner surface of the sleeve, and means carried by the rotary shaft portion for urging the wedge into tight wedging engagement with the tapered inner surface of the sleeve.

14. A dispersing and grinding apparatus according to claim 13; wherein the means disposed at the other end portion of the sleeve comprises a tapered inner surface of the sleeve which tapers radially outwardly in a direction towards the sleeve other end, and the complementary means on the rotary shaft portion comprises a tapered shaft portion which has a taper complementing that of the sleeve tapered inner surface and against which the tapered inner surface of the sleeve is firmly pressed.

15. A dispersing and grinding apparatus according to claim 6; wherein the means detachably connected to the apparatus for rotatably mounting the sleeve includes a frame member detachably connected to the apparatus, the frame member having a pair of supporting arms spaced apart in the axial direction of the sleeve, each of the supporting arms having bearing means for rotatably mounting the sleeve.

16. A dispersing and grinding apparatus according to claim 6; wherein the means for rotatably mounting the sleeve includes sealing means disposed on the sleeve adjacent the region where the processed material exits the separating means for providing a fluidtight seal to prevent leakage of the processed material.

17. A dispersing and grinding apparatus according to claim 16; wherein the sealing means comprises a mechanical seal.

* * * * *